US008955326B2

(12) United States Patent
Bourgois et al.

(10) Patent No.: US 8,955,326 B2
(45) Date of Patent: Feb. 17, 2015

(54) MIXING SCREW FOR A FUEL INJECTOR IN A COMBUSTION CHAMBER OF A GAS TURBINE, AND CORRESPONDING COMBUSTION DEVICE

(75) Inventors: Sébastien Alain Christophe Bourgois, Saint Germain les Corbeil (FR); Didier Hippolyte Hernandez, Quiers (FR); Matthieu François Rullaud, Champagne sur Seine (FR)

(73) Assignee: SNECMA, Paris (FR)

( * ) Notice: Subject to any disclaimer, the term of this patent is extended or adjusted under 35 U.S.C. 154(b) by 607 days.

(21) Appl. No.: 13/266,516

(22) PCT Filed: May 18, 2010

(86) PCT No.: PCT/EP2010/056763
§ 371 (c)(1),
(2), (4) Date: Oct. 27, 2011

(87) PCT Pub. No.: WO2010/133561
PCT Pub. Date: Nov. 25, 2010

(65) Prior Publication Data

US 2012/0047899 A1 Mar. 1, 2012

(30) Foreign Application Priority Data

May 19, 2009 (FR) ..... 09 53335

(51) Int. Cl.
*F02C 1/00* (2006.01)
*F23R 3/12* (2006.01)
*F23R 3/14* (2006.01)

(52) U.S. Cl.
CPC .... *F23R 3/12* (2013.01); *F23R 3/14* (2013.01)
USPC ..... 60/737; 60/740; 60/748

(58) Field of Classification Search
USPC ..... 60/737, 740, 748, 752–760
See application file for complete search history.

(56) References Cited

U.S. PATENT DOCUMENTS

| | | | | |
|---|---|---|---|---|
| 5,832,732 | A * | 11/1998 | Knopfel et al. | 60/760 |
| 5,941,075 | A | 8/1999 | Ansart et al. | |
| 6,019,596 | A * | 2/2000 | Knopfel et al. | 431/350 |
| 6,898,938 | B2 * | 5/2005 | Mancini et al. | 60/748 |
| 7,500,364 | B2 * | 3/2009 | Schumacher et al. | 60/751 |
| 7,546,734 | B2 * | 6/2009 | Dorr et al. | 60/737 |
| 7,549,294 | B2 * | 6/2009 | Buret et al. | 60/804 |
| 2008/0000234 | A1 | 1/2008 | Commaret et al. | |
| 2009/0031729 | A1 | 2/2009 | Hosoi et al. | |
| 2009/0142716 | A1 | 6/2009 | Jubb et al. | |
| 2013/0160452 | A1 | 6/2013 | Bourgois et al. | |

FOREIGN PATENT DOCUMENTS

| | | |
|---|---|---|
| FR | 2 752 917 A1 | 3/1998 |
| FR | 2 903 169 A1 | 1/2008 |
| GB | 2 432 655 A | 5/2007 |

* cited by examiner

*Primary Examiner* — Ehud Gartenberg
*Assistant Examiner* — Arun Goyal
(74) *Attorney, Agent, or Firm* — Oblon, Spivak, McClelland, Maier & Neustadt, L.L.P.

(57) ABSTRACT

In a fuel injection device at a base of a combustion chamber, a mixing air inlet screw is manufactured with its peripheral holes extending only over a sector of a circle directed towards the air's propagation cone, wherein the remainder of the periphery of the screw is closed. It is then possible to reduce load loss of the injection system while obtaining an improved quality of the mix supplied to the chamber. Such a device can be used in gas turbines fitted with centrifugal compressors and in which the air flow towards the combustion chamber must therefore be made convergent.

15 Claims, 2 Drawing Sheets

MIXING SCREW FOR A FUEL INJECTOR IN A COMBUSTION CHAMBER OF A GAS TURBINE, AND CORRESPONDING COMBUSTION DEVICE

The subject of the invention is a mixing screw for a fuel injector in a combustion chamber of a gas turbine.

Figure 1:
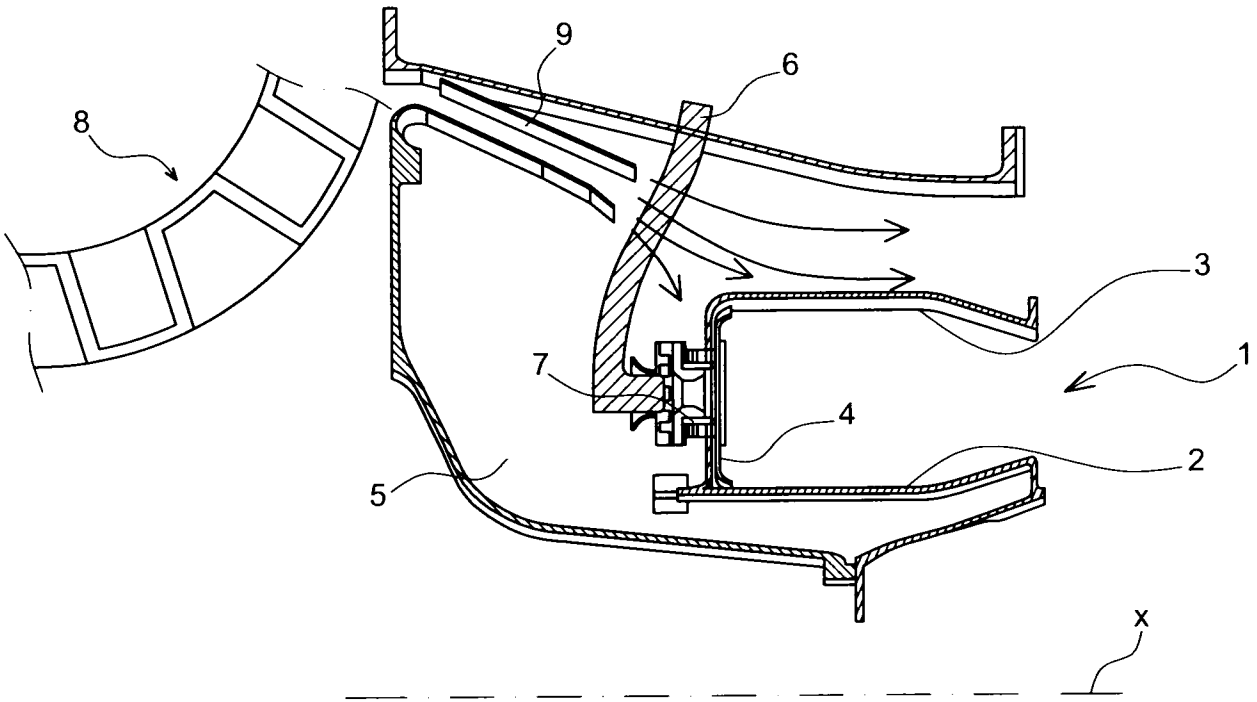

Reference should be made to FIG. 1 for a brief description of such a combustion chamber and its surroundings. It is demarcated by two concentric ferrules 2 and 3, the first being internal and the second external, and by a chamber base 4, which is flat and annular, joining the forward edges of ferrules 2 and 3. The representation of FIG. 1 is shown as a half-section, and the remainder of the structure can be deduced by revolution around an axis X of the gas turbine. Other walls demarcate an air inlet chamber 5 surrounding combustion chamber 1 and extending in front of it, and which is supplied with air used for combustion. The fuel enters combustion chamber 1 by pipes 6 the end of which extends in air inlet chamber 5 before coming to an end in front of the base 4 of combustion chamber 1, to which they are attached by an injection device 7 including a screw of essentially cylindrical shape, and which is hollowed out either side to allow the passage of fuel outside pipes 6 in combustion chamber 1, whilst also being pierced with peripheral holes leading into air inlet chamber 5 to allow combustion air to be drawn in, and a blending with the fuel by whirling. Pipes 6 and injection devices 7 are distributed in a circle around combustion chamber 1, in sufficient number to allow quite regular supply of combustion chamber 1 around its circumference. Since it is known, this distribution has not been represented.

A satisfactory quality of the blend, notably in respect of its uniformity, is required for the quality of the combustion. A satisfactory blend is generally easy to obtain when the gas turbine is fitted with a traditional compressor in front of the combustion chamber, which submits the air to an essentially axial flow; but it is much less easy to obtain when the compressor has a centrifugal end 8 and submits the air to a flow the final radius of which is greater than that of combustion chamber 1. The air then accedes to air inlet chamber 5 through a propagation cone 9 which imposes a centripetal component on its flow, and impairs its regularity. One consequence of this is a lack of uniformity of the air-fuel mix. Another consequence is a greater load loss of the air used for the mixing.

One object of the invention is to improve the quality of the air-fuel mix in combustion chamber 1, notably in such gas turbines with a centrifugal compressor 8 and propagation cone 9.

The inventors have observed that the supply of the screws of the injection devices 7 with air was heterogeneous due to the substantial centripetal component of the flow of the air before chamber 4, such that it exerts a greater dynamic pressure on the radially outer face of the screws, and such that the flow rate entering it is greater through this face.

In accordance with the invention, a mixing screw for a fuel injector in a combustion chamber of a gas turbine is proposed, having the general shape of a hollow cylinder fitted with at least one angular network of feed holes traversing the cylinder as far as the hollow, characterised in that the said network is irregularly distributed over a circumference of the cylinder, and extends only over a sector of a circle. This screw may be used in a combustion device as described, including an annular combustion chamber, a group of fuel injectors leading to a base of the chamber and arranged in a circle, and a means of air inlet located before the combustion chamber, and including a propagation cone of greater radius than the chamber, and directed towards the combustion chamber, characterised in that the fuel injectors include mixing screws in accordance with the foregoing, and the network of feed holes extends before a radially outer portion of the combustion chamber for each of the said mixing screws.

By eliminating a portion of the area of drilling of the screws, a smaller number of feed holes must be relied on to nebulise the fuel, but an improved carburation quality was obtained despite this simplification of the flow outline, which however apparently increases the heterogeneousness of the operating conditions of the mix; and the load loss of the air was reduced, notably by eliminating the holes traversed by the least energetic flow.

The angle covering the feed holes may be small, preferably less than a half-circle or even a quarter-circle, and the number of feed holes is then very small: there may advantageously be only three such.

With a small number of feed holes it is conceivable and often advantageous to choose them with different characteristics and, for example, to stagger them in the axial direction of the screw, or to incline them differently in terms of angular direction, or to give them different drilling sections or different relief angles in the outer radial direction.

The characteristic screw of the invention may also include other networks of feed holes, the latter being uniformly distributed over the circumference according to the customary design or, on the contrary, also being in accordance with the invention.

Figure 2:
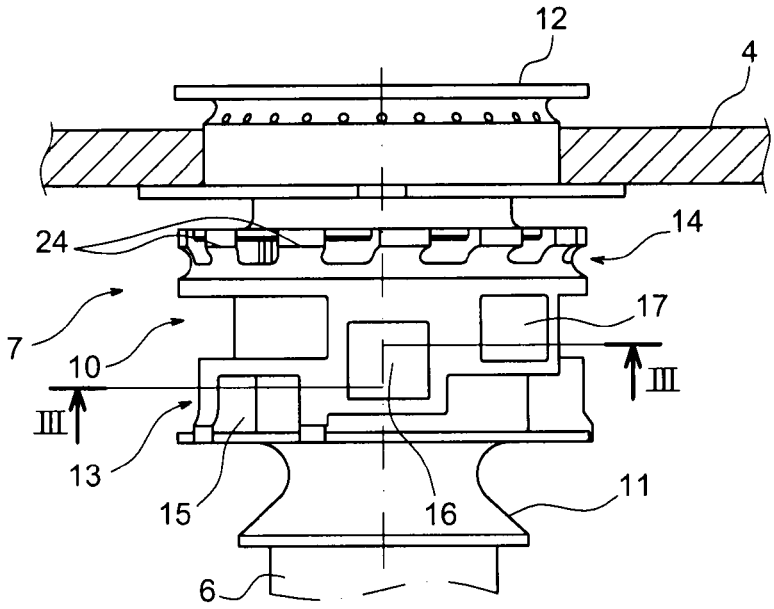
Figure 3:
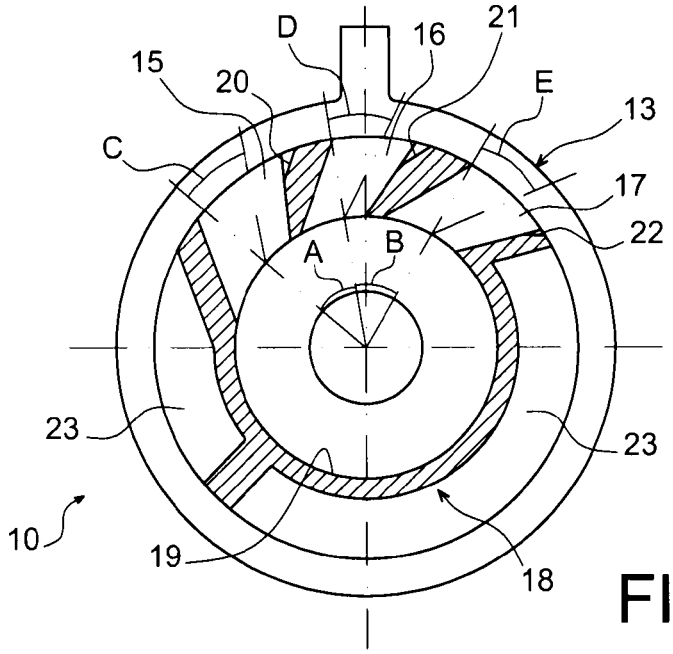

The invention will now be described with reference to the figures:

FIG. 1, already described, illustrates a combustion chamber and its surrounds, and FIGS. 2 and 3 illustrate the invention, where FIG. 2 is an axial section of the injection device including the screw, and FIG. 3 is a section along line III-III of FIG. 2 through the feed holes of the screw.

Injection system 7 is represented in detail in FIG. 2. Screw 10 is inserted between an end 11 to which pipe 6 is connected, and a bowl 12 extending through the base of chamber 4. End 11 and bowl 12 are known models. Screw 10 includes one or more networks of air feed holes, two in this case, one of which, which is close to end 11, is a primary screw 13, and the other, which is close to bowl 12, is a secondary screw 14.

Reference should also be made to FIG. 3, where screw 10 is represented as a section through primary screw 13. It will be noted that the latter consists of three feed holes 15, 16 and 17, which extend only over a section of a circle of screw 10, since their angular separations (angles A and B) are each 45° approximately. The additional sector 18 of primary screw 13 remains solid, and does not therefore allow any air intake. Considering the combustion chamber as a whole, holes 15, 16 and 17 are radially directed towards the outside, and the additional sector is therefore radially directed towards the inside, i.e. towards axis X. This concerns each of the injection devices 7.

The air originating from air inlet chamber 5 therefore enters screw 10 through feed holes 15, 16 and 17 and reaches the central hollow 19 of screw 10, where it is whirled as it mixes with the fuel. It was observed that the load loss of the air between propagation cone 9 and primary screw 13 was small, and that the mix obtained was uniform. It can be seen in FIG. 2 that feed holes 15, 16 and 17 can advantageously be staggered axially in order to reduce the overlaps between the air vortices originating from the different feed holes 15, 16 and 17 in central hollow 19. It is possible to give feed holes 15, 16 and 17 different opening sections, different phase angles (inclinations relative to the radii of screw 10: angles C, D and E) and also different relief angles 20, 21 and 22, i.e. widenings in the angular direction of feed holes 15, 16 and 17 at their external portions on the side of the inlet of the air in order to favour its intake. Relief angles 20, 21 and 22 can be extended through all or part of the depth of holes 15, 16 and 17. Simulation tests and calculations will enable all these settings to be adjusted; the main point is to grasp that their adjustment is made possible by the small number of feed holes 15, 16 and 17 and by their incomplete extension over a circle which gives great latitude to modify their shapes or their positions without excessive complexity.

A possible disadvantage of the screw according to the invention is its greater weight if axial staggering of the holes requires it to be lengthened; but it is possible to attenuate this fault by contour millings 23 outside primary screw 13, over the additional sector 18.

Secondary screw 14 represented here is traditional, i.e. it has feed holes 24 distributed regularly around its circumference: for this reason it has not been represented in detail. Since there are more feed holes 24, their section is smaller than that of feed holes 15, 16 and 17 and primary screw 13. The number and indeed the presence of secondary screws are not, however, critical, and they could also be in accordance with the invention.

The invention claimed is:

1. A mixing screw for a fuel injector for a combustion chamber of a gas turbine, comprising:

a general shape of a hollow cylinder having a circumference divided into two sectors, a first sector and a second sector, the first sector including an angular network of feed holes for air traversing the cylinder as far as the hollow, and the second sector being solid and free of feed holes traversing the cylinder, wherein the feed holes of the angular network are irregularly distributed over the first sector of the circumference of the cylinder, the first sector being less than a half of the circumference.

2. A fuel mixing screw according to claim 1, wherein the first sector with said feed holes is less than a quarter-circle.

3. A fuel mixing screw according to claim 1, wherein the feed holes are staggered in the cylinder's axial direction.

4. A fuel mixing screw according to claim 3, wherein said first sector with said feed holes has three feed holes.

5. A fuel mixing screw according to claim 1, wherein the feed holes have different inclinations in their angular directions.

6. A fuel mixing screw according to claim 1, wherein the feed holes are at a relief angle, with increasing widths in their angular directions, moving in the outer radial direction.

7. A fuel mixing screw according to claim 1, further comprising at least one other angular network of feed holes traversing the cylinder as far as the hollow, wherein the other angular network of feed holes is distributed over a circle, or over only a sector of a circle.

8. A fuel mixing screw according to claim 1, wherein the cylinder covers said second sector of the circumference in addition to the first sector of the circumference over which the angular network of feed holes extends.

9. A fuel mixing screw according to claim 1, wherein said second sector extends radially from said hollow to an exterior of said cylinder.

10. A fuel mixing screw according to claim 9, wherein said second sector free of any feed holes is more than half of said circumference.

11. A fuel mixing screw according to claim 1, wherein said second sector free of any feed holes is more than three quarters of said circumference.

12. A gas turbine combustion device, comprising:

an annular combustion chamber;

a group of fuel injectors leading to a base of the chamber and arranged in a circle; and an air inlet device located before the combustion chamber, and including a propagation cone of greater radius than the chamber, and directed towards the combustion chamber, wherein the fuel injectors include mixing screws having a general shape of a hollow cylinder having a circumference divided into two sectors, a first sector and a second sector, the first sector including an angular network of feed holes traversing the cylinder as far as the hollow, the second sector being solid and free of feed holes traversing the cylinder, and the feed holes of the angular network are irregularly distributed over the first sector of the circumference of the cylinder, the first sector being less than a half of the circumference, and the angular network of feed holes extends before a radially outer portion of the combustion chamber for each of the mixing screws.

13. A gas turbine combustion device according to claim 12, wherein said second sector extends radially from said hollow to an exterior of said cylinder.

14. A gas turbine combustion device according to claim 13, wherein said second sector free of any feed holes is more than half of said circumference.

15. A gas turbine combustion device according to claim 12, wherein said second sector free of any feed holes is more than three quarters of said circumference.

* * * * *